US006899571B1

(12) United States Patent
Koch et al.

(10) Patent No.: US 6,899,571 B1
(45) Date of Patent: May 31, 2005

(54) RADIALLY RESILIENT ELECTRICAL CONNECTOR WITH WELDED GRID

(75) Inventors: Joseph J. Koch, Harrison Township, MI (US); Michael E. Uppleger, Marine City, MI (US); Dean D. Swearingen, deceased, late of Clinton Township, MI (US); by Judith J. Swearingen, legal representative, Clinton Township, MI (US)

(73) Assignee: KonneKtech Ltd., Fraser, MI (US)

( * ) Notice: Subject to any disclaimer, the term of this patent is extended or adjusted under 35 U.S.C. 154(b) by 0 days.

(21) Appl. No.: 10/117,368

(22) Filed: Apr. 5, 2002

Related U.S. Application Data

(63) Continuation-in-part of application No. 09/568,910, filed on May 11, 2000.
(60) Provisional application No. 60/330,188, filed on Oct. 18, 2001.

(51) Int. Cl.[7] ..... H01R 13/187; H01R 11/22
(52) U.S. Cl. ..... 439/843; 439/851
(58) Field of Search ..... 439/843, 842, 439/841, 851, 852, 854

(56) References Cited

U.S. PATENT DOCUMENTS

| | | | | |
|---|---|---|---|---|
| 1,833,145 | A | 11/1931 | Wilhelm | |
| 3,396,364 | A | 8/1968 | Bonhomme | 339/217 |
| 3,470,527 | A | 9/1969 | Bonhomme | 339/256 |
| 3,517,374 | A | 6/1970 | Bonhomme | 339/176 |
| 3,557,428 | A | 1/1971 | Bonhomme | 29/203 |
| 3,626,361 | A | 12/1971 | Bonhomme | 339/217 |
| 3,641,483 | A | 2/1972 | Bonhomme | 339/217 |
| 3,686,622 | A | 8/1972 | Bonhomme | 339/217 |
| 3,808,589 | A | 4/1974 | Bonhomme | 339/217 |
| 3,858,962 | A | 1/1975 | Bonhomme | 339/256 |
| 4,128,293 | A | 12/1978 | Paoli | 339/258 |
| 4,175,821 | A | 11/1979 | Hunter | 339/258 |
| 4,203,647 | A | 5/1980 | Bonhomme | 339/256 |
| 4,657,335 | A | 4/1987 | Koch et al. | 339/256 |
| 4,720,157 | A | 1/1988 | Nestor et al. | 438/851 |
| 4,734,063 | A | 3/1988 | Koch et al. | 439/844 |
| 4,902,235 | A | 2/1990 | Tonooka | 439/72 |
| 5,033,982 | A | 7/1991 | Lucas | 439/750 |
| 5,108,318 | A | 4/1992 | Sakurai et al. | 439/744 |
| 5,147,229 | A | 9/1992 | Nestor | 439/843 |
| 5,326,289 | A | 7/1994 | Leisey | 439/851 |
| 5,378,552 | A | 1/1995 | Dixon et al. | 429/91 |
| 5,416,286 | A | 5/1995 | Dixon et al. | 200/16 |
| 5,511,307 | A | 4/1996 | Reiersgaard et al. | 29/863 |
| 5,607,328 | A | 3/1997 | Joly | 439/852 |
| 5,662,497 | A | 9/1997 | Reilly | 439/627 |
| 5,735,716 | A | 4/1998 | Bilezikjian | 439/843 |
| 6,250,974 | B1 | 6/2001 | Kerek | 439/842 |
| 6,482,049 | B1 * | 11/2002 | Swearingen | 439/843 |
| 6,752,668 | B2 * | 6/2004 | Koch, Jr. | 439/843 |
| 2003/0068931 | A1 * | 4/2003 | Swearingen et al. | 439/843 |
| 2003/0077950 | A1 * | 4/2003 | Swearingen et al. | 439/843 |
| 2004/0003498 | A1 * | 1/2004 | Swearingen et al. | 29/862 |
| 2004/0033732 | A1 * | 2/2004 | Koch | 439/843 |

FOREIGN PATENT DOCUMENTS

| | | |
|---|---|---|
| GB | 1136589 | 12/1968 |
| GB | 2065993 | 7/1981 |
| WO | WO 98/43321 | 10/1998 |

* cited by examiner

*Primary Examiner*—Chandrika Prasad
(74) *Attorney, Agent, or Firm*—Blank Rome LLP

(57) ABSTRACT

An electrical connector and method of making the same includes a radially resilient, cylindrical electrical contact member having a plurality of spaced strips extending between opposite ends of a sleeve. The ends of the strips are welded in the sleeve in an angularly offset, end-to-end position.

4 Claims, 10 Drawing Sheets

RADIALLY RESILIENT ELECTRICAL CONNECTOR WITH WELDED GRID

CROSS REFERENCE TO CO-PENDING APPLICATIONS

This application is a continuation-in-part of co-pending application Ser. No. 09/568,910, filed May 11, 2000, and, also, claims the benefit of the filing date of co-pending provisional patent application Ser. No. 60/330,188, filed Oct. 18, 2001, the contents of both of which are incorporated herein in their entirety.

BACKGROUND

The present invention relates, in general, to electrical connectors and, more specifically, to radially resilient electrical sockets, also referred to as barrel terminals, in which a cylindrical electrical prong or pin is axially inserted into a socket whose interior surface is defined by a plurality of contact strips or wires mounted within a cylindrical sleeve and inclined between angularly offset ends.

Radially resilient electrical sockets or barrel terminals are a well known type of electrical connector as shown in U.S. Pat. Nos. 4,657,335 and 4,734,063, both assigned to the Assignee of the present invention.

In such electrical sockets or barrel terminals, a generally rectangular stamping is formed with two transversely extending webs spaced inwardly from and parallel to opposite end edges of the sheet. Between the inner side edges of the transverse web, a plurality of uniformly spaced, parallel slots are formed to define a plurality of uniformly spaced, parallel, longitudinally extending strips which are joined at opposite ends to the inward side edges of both transverse webs. Other longitudinally extending slots are coaxially formed in the sheet and extend inwardly from the end edges of the blank to the outer side edges of the transverse webs to form a plurality of uniformly spaced, longitudinally extending tabs projecting outwardly from each transverse web.

The blank or sheet is then formed into a cylinder with the longitudinal strips extending parallel to the axis of the now cylindrical sheet. A closely fitting cylindrical sleeve is slipped coaxially around the outer periphery of the cylindrical blank, and extends axially substantially between the outer edges of the transverse webs. The mounting tabs at each end of the blank are then bent outwardly across end edges of the sleeve into radially extending relationship to the sleeve.

A relatively tight-fitting annular collar or outer barrel is then axially advanced against the radially projecting tabs at one end of the sleeve and slipped over the one end of the sleeve driving the tabs at that end of the sleeve downwardly into face-to-face engagement with the outer surface of the one end of the sleeve. The fit of the annular collar to the sleeve is chosen so that the end of the cylindrical blank at which the collar is located is fixedly clamped to the sleeve against both axial or rotary movement relative to the sleeve. A tool typically having an annular array of uniformly spaced, axially projecting teeth is then engaged with the radially projecting tabs at the opposite end of the sleeve. The teeth on the tool are located to project axially between the radially projecting tabs closely adjacent to the outer surface of the cylindrical sleeve. The tool is then rotated about the longitudinal axis of the cylindrical sleeve while the sleeve is held stationary to rotatably displace the engaged tabs approximately 15° to 45° from their original rotative orientation relative to the sleeve and the bent over tabs at the opposite end of the sleeve. The tool is then withdrawn and a second annular collar or outer barrel is force fitted over the tabs and the sleeve to fixedly locate the opposite end of the blank in a rotatably offset position established by the tool. When completed, such an electrical socket has longitudinal strips extending generally along a straight line between the angularly offset locations adjacent the opposite ends of the cylindrical sleeve. The internal envelope cooperatively defined by the longitudinal strips is a surface of revolution coaxial to the axis of the cylindrical sleeve having equal maximum radii at the points where the strips are joined to the respective webs and a somewhat smaller radius midway of the length of the strips. The minimum radius, midway between the opposite ends of the strips, is selected to be slightly less than the radius of a cylindrical connector pin which is to be inserted into the barrel socket so that the insertion of the pin requires the individual longitudinal strips to stretch slightly longitudinally to firmly frictionally grip the pin when it is seated within the barrel socket.

To put it another way, because of the angular offset orientation of the opposed ends of each of the strips, each strip is spaced from the inner wall of the sleeve in a radial direction progressively reaching a maximum radial spacing with respect to the outer sleeve midway between the ends of the sleeve.

Such a radially resilient electrical barrel socket provides an effective electrical connector which provides secure engagement with an insertable pin; while still enabling easy manual withdrawal or insertion of the pin relative to the socket. Such connectors also provide a large electrical contact area between the pin and the socket which enables such connectors to be employed in high current applications.

It is also known to construct such an electrical connector in a manner in which one of the collars is formed as an integral part or extension of a support member forming a part of the overall connector. The afore-described assembly process remains the same except that the separate collars at both ends of the socket are replaced by one collar at one end and a hollow, cylindrical extension of a connector which can be inserted into or otherwise electrically connected to an electrical device, such as a vehicle alternator, etc. The hollow cylindrical end of the support receives and holds the tabs at the first end of the sleeve tight against rotation while the opposing tabs are angularly rotated. A collar or end cap is then clamped over the rotated tabs to maintain such tabs in the rotated position.

However, it is believed that further modifications or enhancements could be made to such radially resilient electrical sockets to reduce the manufacturing cost as well as to simplify the mounting or attachment of such sockets or terminals to an electrical device to which they are to be electrically connected.

SUMMARY

The present invention is, according to one aspect, an electrical connector having an improved radially resilient electrical socket or barrel terminal forming a part thereof which has a significantly reduced manufacturing cost and, at the same time, a simplified construction for mounting in an associated electrical device.

According to one aspect of the present invention, an electrical connector apparatus comprises: a holder having a cylindrical portion with a bore extending at least from one end; a barrel terminal coaxially received within the cylindrical portion of the housing, the barrel terminal including: a contactor member formed of a one piece sheet having a pair of axially spaced, coaxial, annular webs fixedly seated against the inner surface of a cylindrical sleeve; a plurality of elongate strips integrally joined at one end to one of the webs and integrally joined at an opposite end to the other of the webs, the strips being joined to the webs at uniformly spaced intervals about the respective circumferences of the webs; the location at which each strip is joined to said one of the webs being angularly displaced about the common axis of the webs from the location at which the strip is joined to the other of the webs; a plurality of mounting tabs integrally joined to each web and extending from the respective web around an adjacent end edge of the cylindrical sleeve and into face-to-face engagement with an outer surface of the sleeve; and wherein: the inner surface of the bore in the cylindrical portion of the holder fixes the tabs into face-to-face engagement with the outer surface of the sleeve.

The holder preferably includes an electrical conductive portion connectable to an electrical use device. An electrically conductive pin is insertable into the barrel terminal into electrical contact with the strips.

In one aspect, the holder is formed as a unitary, one piece part of an electrical use device.

In another aspect, the contact member has a plurality of strips extending from one end of the blank. The strips are folded over the interior of the blank before the blank is formed into a cylindrical shape forming the cylindrical sleeve. The opposite ends of the contact strips are folded over the exterior surface of the sleeve, are shortened and engaged with the end surface of the sleeve or are further shortened and disposed completely interiorly within the sleeve. In all cases, the opposite ends of the contact strips are fixedly joined to the sleeve, such as by welding.

In another aspect, the method comprises:

forming a plurality of longitudinally extending grooves in the cylindrical portion parallel to the longitudinal axis of the cylindrical portion; and inserting each bent over tab at each end of the cylindrical sleeve into one of the grooves as the sleeve is urged into the bore in the cylindrical portion of the holder.

In another aspect of the invention, the method comprises:

forming the contact member of an electrically conductive material in the form of a flat blank having opposed first and second side ends;

forming a plurality of slits alternatingly in the blank, with one strip extending from a first end at one side end of the blank to an opposite end spaced from an opposite side end of the blank in the adjacent slit extending from a first end at the opposite side end of the blank to an opposed end spaced from the first side end of the blank to form solid metal portions at alternating ends of two adjacent strips;

laterally expanding the blank to space one end of two adjacent strips from each other while maintaining the opposed ends of two adjacent strips in contact by the solid metal portion;

fixedly mounting the opposed ends of each strip to first and second spaced flat blanks;

forming the first and second blanks into cylindrical sleeves;

angularly rotating the one so the sleeves with respect to the other sleeve to angularly offset one end of the strips from the opposite end of each strip; and fixedly connecting the first and second sleeves together to maintain the opposed ends of the contact strips in the angular offset position.

The electrical connector and/or radially resilient electrical socket of the present invention has a significantly reduced cost as compared to previously devised, similar radial resistant electrical sockets due to the elimination of both collars or rings. Further, the radially resistant electrical socket or barrel terminal can be easily installed into well known electrical terminals or holders and be integrated therewith without the need for substantial modification to the existing holders.

BRIEF DESCRIPTION OF THE DRAWING

The various features, advantages and other uses of the present invention will become more apparent by referring to the following detailed description and drawing in which.

DETAILED DESCRIPTION

The structure of a barrel socket used in an electrical connector according to one aspect of the present invention is best explained by a description of the manner in which it is manufactured.

Figure 1:
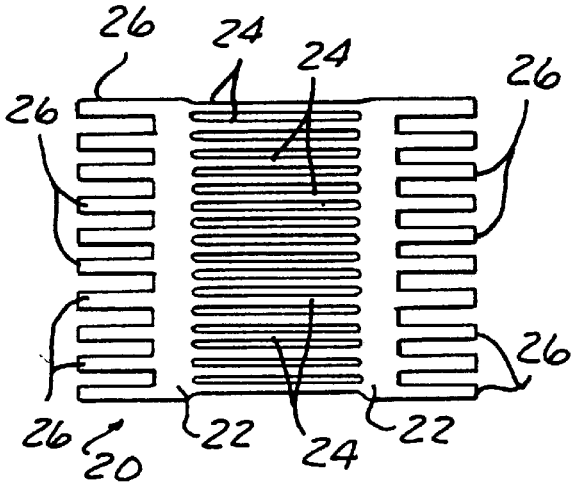
FIG. 1 PRIOR ART
FIG. 1 is a plan view of a flat sheet metal blank employed in constructing a barrel terminal for the present invention.

The first step in the manufacture of the barrel socket is the stamping of a blank in the form shown in FIG. 1 from a flat piece of sheet metal which preferably is a beryllium copper alloy which has both mechanical and electrical properties well adapted for this application.

Referring to FIG. 1, the blank designated generally 20 is stamped in a generally rectangular configuration and formed with a pair of spaced, parallel, transversely extending connecting web portions 22 which are integrally connected to each other by a plurality of uniformly spaced, parallel, longitudinally extending strips 24 which extend between the respective inner edges of the webs 22. A plurality of spaced, parallel tabs 26 project longitudinally outwardly from the outer edges of the respective transverse webs 22.

Figure 2:
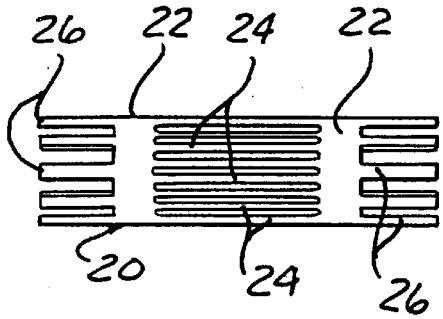
FIG. 2 PRIOR ART
FIG. 2 is a side elevational view of the blank of FIG. 1 formed into a cylinder.

The second step in the manufacturing process is shown in FIG. 2 and finds the blank 20 formed into a horizontal, cylindrical, tubular configuration, the axis of the cylindrical tube extending parallel to the longitudinal strips 24 and tabs 26.

Figure 3:
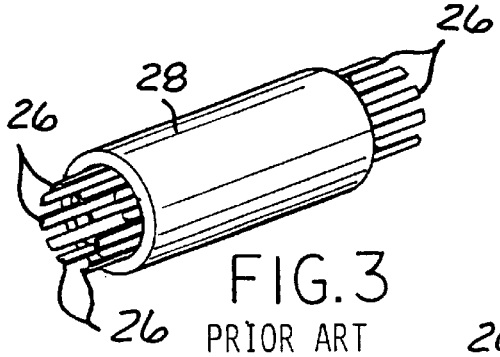
FIG. 3 PRIOR ART
FIG. 3 is a perspective view showing a close fitting cylindrical sleeve disposed about the blank of FIG. 2.

After the blank 20 is formed into the cylindrical tubing configuration of FIG. 2, a close-fitting cylindrical sleeve 28 is slipped over the tube as shown in FIG. 3, the axial length of sleeve 28 being sufficient to extend over both of transverse webs 22 leaving the tabs 26 projecting outwardly from the opposite ends of sleeve 28.

Figure 4:
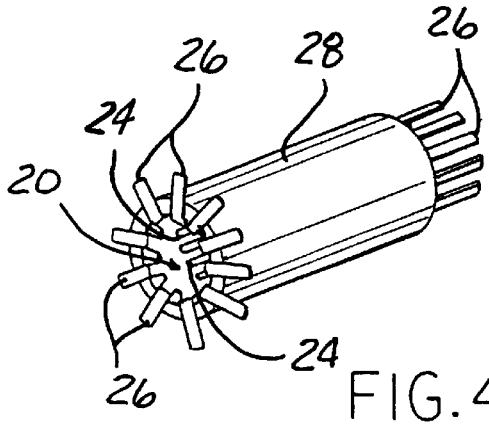
FIG. 4 PRIOR ART
FIG. 4 is a perspective view of a subsequent step in the construction of the barrel terminal.

In the next step shown in FIG. 4, the projecting tabs 26 are flared or bent outwardly across one end edge of sleeve 28 to project radially outwardly of the axis of the sleeve.

Figure 5:
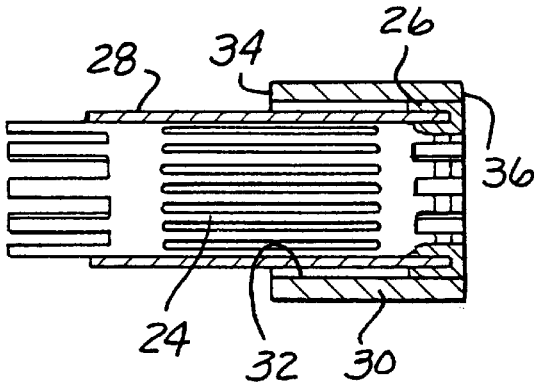
FIG. 5 PRIOR ART
FIG. 5 is an enlarged side elevational, cross-sectional view showing a subsequent step in the construction method.

In the next step of the process shown in FIG. 5, a temporary first housing or fixture 30 has a central bore 32 extending at least from a first end 34 to an opposite end 36. The bore 32 has a diameter larger than the diameter of the cylindrical sleeve 28 by a distance equal to the thickness of the tabs 26. The first housing 30 is axially driven over one end of the sleeve 28 or the sleeve 28 is axially driven into one of the first and second ends 34 and 36 of the first housing 30. The forcible interconnection of the sleeve 28 and the first housing 30 bends the radially flared tabs 26 at the one end of the sleeve 28 back on themselves into overlapping, face-to-face relationship with the outer surface of the sleeve 28. The inner diameter of the bore 32 is chosen such that when the first housing 30 and the first end of the blank 20 and the sleeve 28 are in the position shown in FIG. 5, the first housing 30 exerts sufficient force on the tabs 26 to clamp the tabs 26 against the outer surface of the sleeve 28 to prevent any axial or rotary movement of the tabs 26 relative to the sleeve 28.

Figure 6:
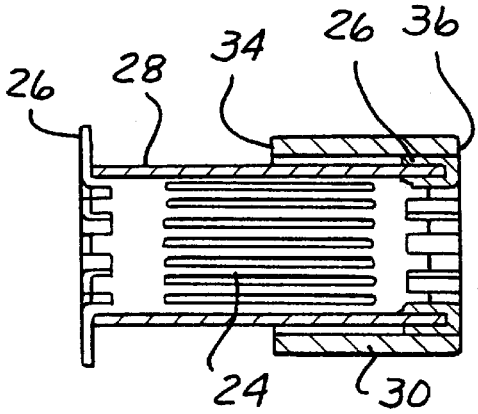
FIG. 6 PRIOR ART
FIG. 6 is an enlarged side elevational, cross-sectional view showing yet another step in the construction method.

Next, as shown in FIG. 6, the tabs 26 at the opposite end of the sleeve 28 are flared or bent radially outwardly across the opposite end edge of the sleeve 28 to project radially outward from the axis of the sleeve 28.

Figure 7:
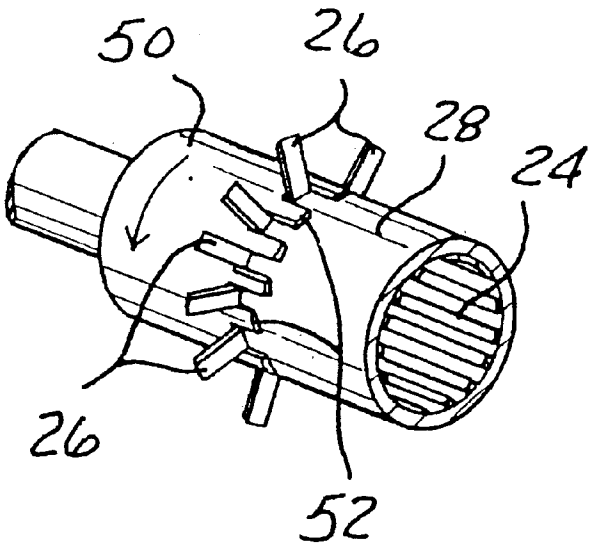
FIG. 7 PRIOR ART
FIG. 7 is a perspective view depicting another step in the construction method.

In the next step shown in FIG. 7, a tubular tool 50 having uniformly spaced, axially projecting teeth 52 on one end is engaged with the radially projecting tabs 26 projecting out of one end of the sleeve 28. The internal diameter of the tool 50 is such that it will have a loose, sliding fit with the outer diameter of the sleeve 28 and the teeth 52 are so spaced from each other so as to project through the spaces between the adjacent, radially projecting tabs 26.

When the tool 50 is seated with the teeth 52 between the radially projecting tabs 26, the first housing 30 is clamped or otherwise held against rotation and the tool 50 rotated coaxially of the sleeve 28 through a predetermined angle, which is typically from about 15° to about 45°. This action of the tool 50 rotatably offsets one end of the blank or sheet 20 from the previously fixed end held against rotation by the first housing 30 relative to the sleeve 28. The characteristics of the beryllium copper alloy of which the blank or sheet 20 is preferably made is such that, although the material possesses some resiliency, the rotation imparted by the tool 50 permanently sets the blank 20 in the rotated position.

Figure 8:
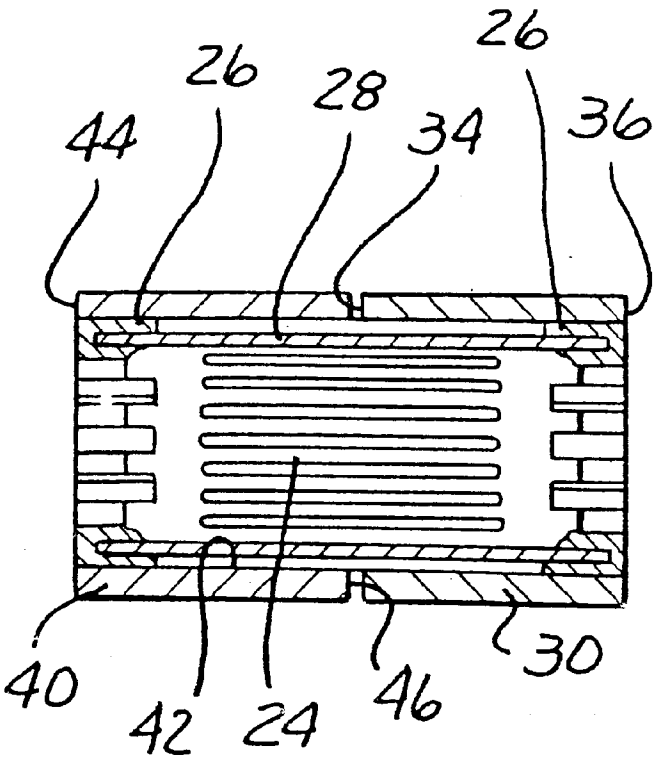
FIG. 8 PRIOR ART
FIG. 8 is a side elevational, longitudinal cross-sectional view of the final assembled state of the barrel terminal.

Next, as still shown in FIG. 8, a second housing 40 also having a through bore 42 extending from a first end 44 to an opposed second end 46 is axially driven over the sleeve 28 into interference with the radially outward extending tabs 26 or the ends of the sleeve 28 and the blank 20 extending outward from the first housing 30 are axially driven into the bore 42 in the second housing 40. The second housing 42 is then advanced relative to the first housing 30 to force fit the interior surfaces of the bore 42 in the second housing 40 into engagement with the radially extending, angularly offset tabs 26 thereby bending the tabs 26 over into face-to-face engagement with the outer surface of the other end of the sleeve 28.

The second housing 40 and the first housing 30 are advanced relative to one another into abutment to hold the angularly offset tabs 26 at each end of the sleeve 28 non-movably against the outer surface of the sleeve 28.

However, the above-described barrel terminal has opposed open ends allowing access to the tabs 26 on the blank or grid 20 from either end to perform the above-described bending, inserting and locking operations.

According to one aspect of the present invention, a modified barrel terminal is mounted in a terminal housing 60 having a barrel terminal receiving portion or body 62 and a contiguous, generally axially or angularly spaced conductor or pin receiving portion 64. Thus, although the barrel terminal receiving portion or housing 62 is shown axially aligned with pin or conductor receiving portion or body 64, it will be understood that the two body portions 62 and 64, while contiguous or connected, can be disposed at any angular orientation, such as a 45°, 90°, etc.

According to the present invention, the barrel terminal receiving portion or body 62 has a first open end 66 which is hereafter defined as a"first or external end". A bore 68 extends from the first external end 66 to an internal wall 70, hereafter also referred to as a "blind end".

The pin receiving body 64 likewise has a first open end 72 and a through bore 74 extending from the first open end 72 to an internal wall 76. The bore 74 is configured for receiving a pin or conductor in an electrical connection.

In addition, the pin receiving body 64 can also be configured as part of an electrical use device, such as a battery wherein the body 64 is formed as an integral part of the battery within an internal electrical connection made by appropriate means to the body 64.

Figure 9:
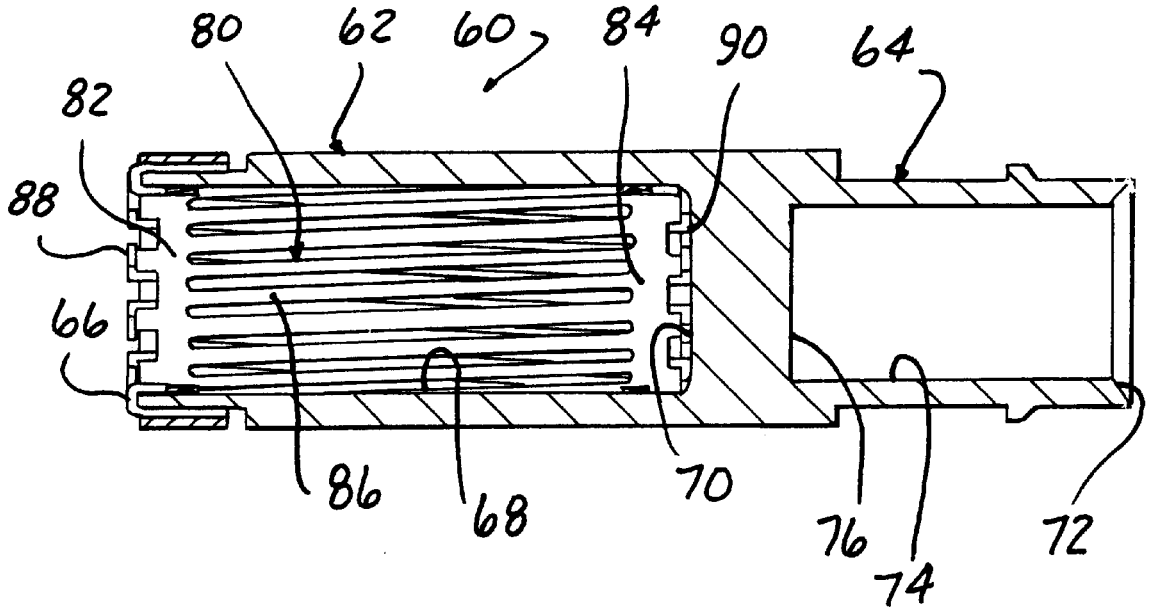
FIG. 9 is a longitudinal cross-sectional view of a connector having a barrel terminal constructed according to the present invention mounted therein.

The terminal housing 60 shown in FIG. 9, can be produced from either stamped parts formed from flat metal stock and then formed into the desired cylindrical configuration or machined from metal bar stock.

A barrel terminal 80 constructed according to any one of several different methodologies is mountable in the bore 68 of the barrel terminal body 62. As described in greater detail hereafter, the barrel terminal 80 is formed of a stamped grid having webs 82 and 84 at opposite ends of a plurality of interconnecting strips 86. Tabs 88 extend oppositely from the webs 82 and 84, respectively, and are secured in place to the barrel terminal body 62 by external end anchors and internal end anchors described hereafter. After the strips 86 have been angularly offset from end to end to dispose each strip in a hyperbolic shape from end to end having a smaller internal diameter at a generally center point than the nominal, non-hyperbolic state of the strips 82. This diameter is typically smaller than the outer diameter of a pin or conductor inserted into the barrel terminal 80 so as to provide a secure electrical contact between the barrel terminal and the inserted pin as well as a high pin pull-out retention force.

Alternately, the strips 86 of the barrel terminal 80 can be replaced by individual wires which are initially held in place by narrow neck portions or ribs between opposite ends of the wires which are separated during the hyperbolic angular offset process. The ends of each of the wires then act as the tabs for securement to the barrel terminal body 62 by the external and internal anchors described hereafter. Such a wire arrangement will also be understood to constitute a "grid" as the term is used herein. As also described hereafter, several aspects of the barrel terminal 80 may not require tabs at either the external or internal end of the barrel terminal 80.

The following description will encompass several different aspects of an external grid anchor used to fixedly mount one end of the barrel terminal 80 in a fixed position relative to the barrel terminal body 62 after the hyperbolic angular offset is applied to the strips 86 of the barrel terminal 80 which is only partially illustrated in the following figures.

Figure 10:
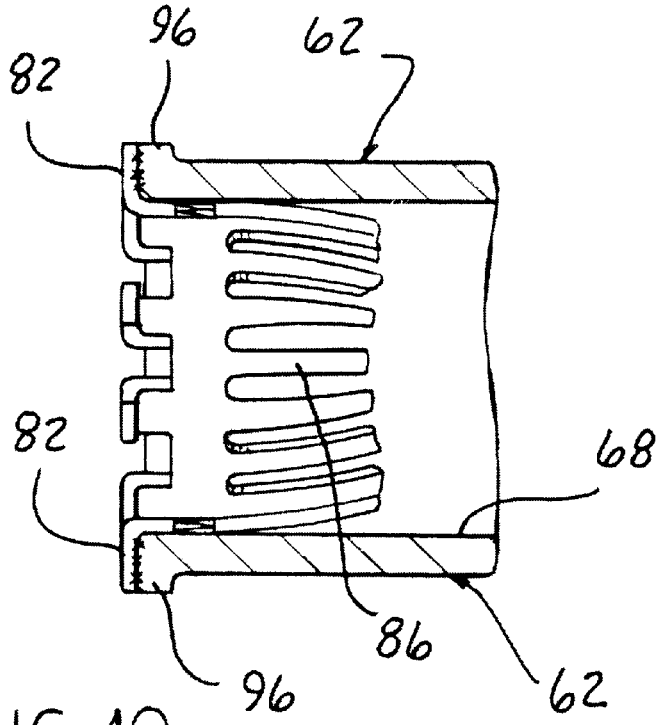
FIG. 10 is a partial, longitudinal cross-sectional view of one aspect of an external grid anchor for the barrel terminal shown in FIG. 9.

As shown in FIG. 10, in one aspect, the external end 96 of the barrel terminal body 62 is flared outward in an annular flange. The tabs 88 at the external end of the barrel terminal 80 are either pre-bent or bent radially outward after the barrel terminal 80 is inserted into the bore 68 in the barrel terminal body 62. The radially disposed tabs 88 are fixedly secured to the exterior surface of the flange 96 by suitable means, such as by welding. Although, low temperature brazing or soldering could also be employed to fixedly secure the tabs 88 to the flange 96, either ultrasonic or impulse (capacitor-discharge) welding processes may be better suited for the typical beryllium-copper construction of the grid of the barrel terminal 80 since these processes generate only momentary, localized heating which is confined to the touching surfaces of the tabs 88 and the flange 96 thereby resulting in little adverse effect on the metal properties of the remainder of the grid or the barrel terminal 80.

Figure 11:
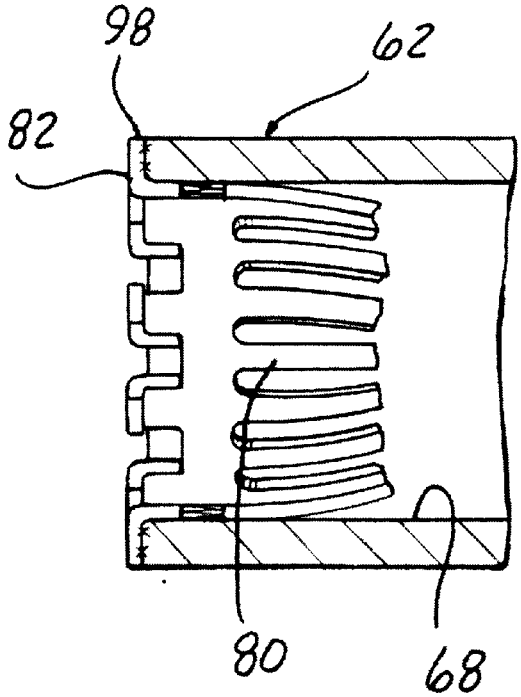
FIG. 11 is a partial, longitudinal cross-sectional view of another aspect of an external grid anchor for the barrel terminal shown in FIG. 9.

The external grid anchor shown in FIG. 11 is similar to the external grid anchor described above and shown in FIG. 10, except that the external end of the barrel terminal body 62 does not include the radially extending flange 96. Rather, the external end 98 of the barrel terminal body 62 is merely an axial end of the body sidewall. The tabs 88 are still radially outwardly bent or pre-formed so as to wrap around and engage the external end 98. The tabs 88 are then fixed to the end 98 by welding as described above. Dimples, not shown, are formed on the facing surface of one of the tabs 88 or the end of the body 62 for forming the weld.

Figure 12:
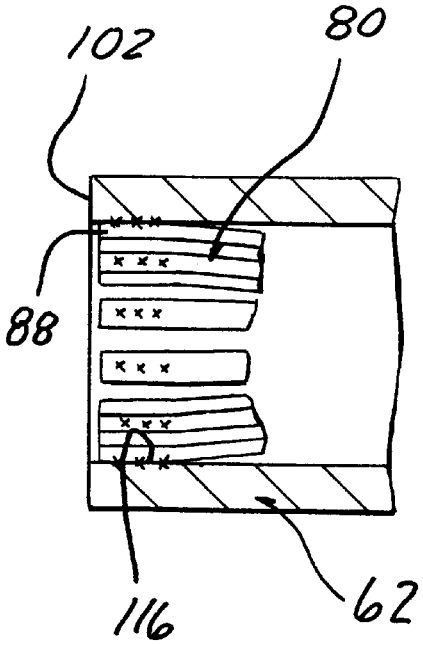
FIG. 12 is a partial, longitudinal cross-sectional view showing another aspect of an external grid anchor of the present invention.

In the aspect of the external grid anchor shown in FIG. 12, the overall length of the barrel terminal 80 is such that the tabs 88 or merely the ends of the strips 86 forming the grid of the barrel terminal 80 are angularly disposed in a pre-stressed shape to exert a radially outward contact force against an inner surface 116 adjacent the inner surface of the end 102 of the barrel terminal body 62. The tabs 88 are fixed in place after the angular offset is formed between the ends of the grid strips in the barrel terminal 80 by suitable welding processes, such as ultrasonic welding, impulse-capacitor-discharge welding or possibly low-temperature brazing or soldering.

Figure 13:
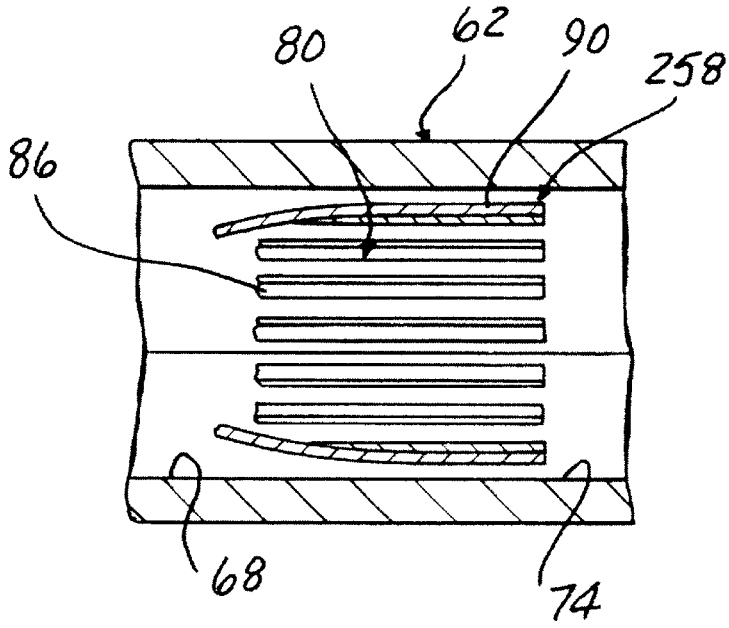
FIGS. 13 and 14 are partial, enlarged, longitudinal cross-sectional views showing another aspect of an internal anchor according to the present invention in a partially assembled and completely assembled state, respectively.
Figure 14:
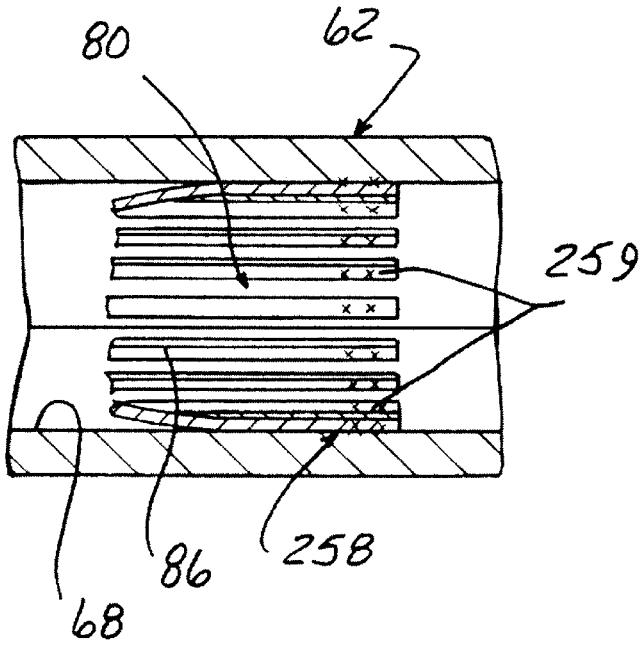

The internal grid anchor 258 depicted in FIGS. 13 and 14 requires a terminal housing 60 in the form of a hollow cylindrical form made from flat stock which is then formed or bent into a cylindrical configuration with oppositely extending bore portions 68 and 74. In the anchor 258, the barrel terminal 80 has the tabs 90 or ends of the strips 86 disposed generally in line with the strips 86 and not at any significant inward extending, pre-formed angle. The flattened grid containing the strips 86 or individual wires forming the strips 86 are secured by an internal grid anchoring technique employing welds shown by reference number 258 at the internal end of each strip 86. Welding or joining processes must be selected so that the metal properties of the grid of the barrel terminal 80 or the entire terminal housing 60 are not adversely effected by the process heat or pressure. Suitable joining processes can include ultrasonic welding, impulse/capacitor-discharge welding, and low-temperature brazing/soldering.

After the internal ends or tabs 90 of the strips 86 of the barrel terminal 80 have been welded to the inner surface of the terminal housing 60, the terminal housing 60 is formed into the cylindrical shape with the opposed side edges fixedly joined together, by interlocking mechanical connection, welding, etc.

Figure 15:
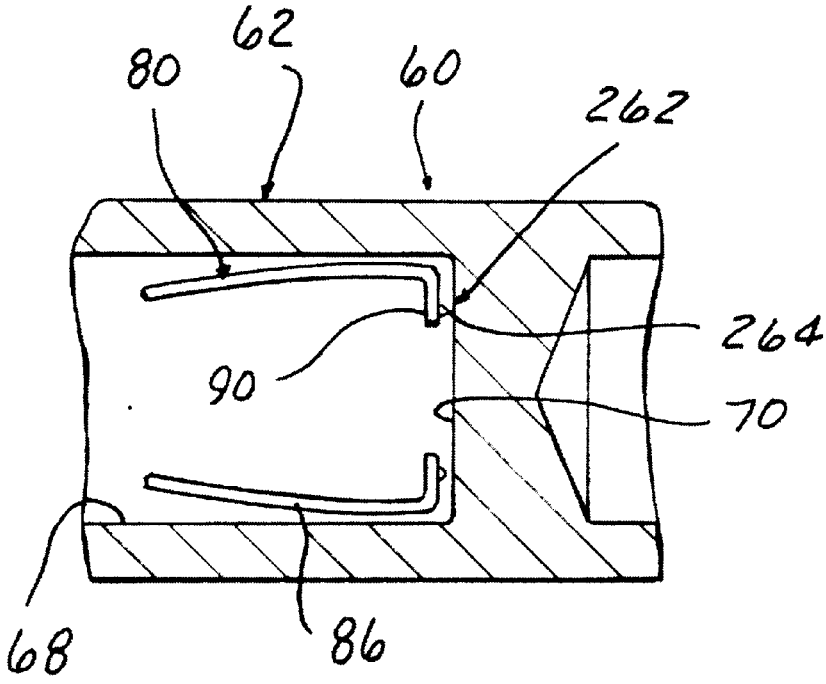
FIGS. 15 and 16 are partial, enlarged, longitudinal cross-sectional views showing another aspect of an internal anchor according to the present invention in a partially assembled and completely assembled state, respectively.
Figure 16:
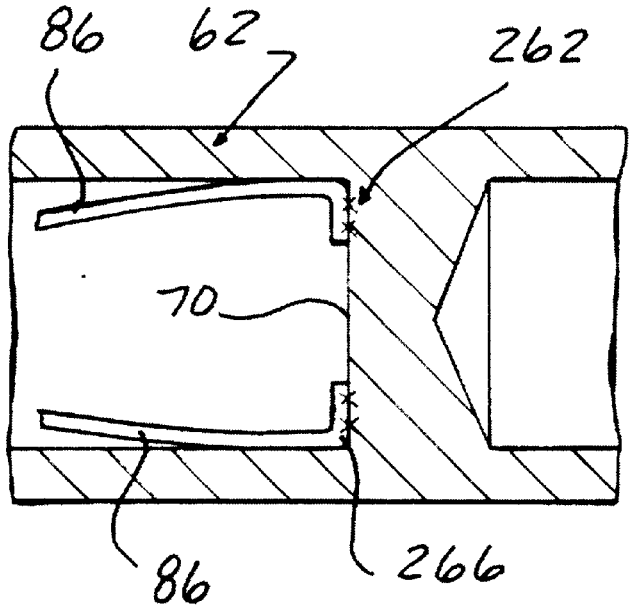

In FIGS. 15 and 16, yet another internal grid anchor 262 is depicted. The internal grid anchor 262 is suited for use with the barrel terminal body 62 described above and shown in FIG. 9. The barrel terminal 80 has the tabs 90 at the ends of the strips 86 pre-formed or bent into an angular, generally perpendicular orientation. The barrel terminal 80 may also be formed of individual strips which are not initially provided in an integral, web connected, grid configuration.

The internal grid anchor 262 includes projections or contact points 264 formed on an outer surface of each projection 90 facing the internal wall 70 in the bore 68. The projections 264 are at right angles to the axis of the bore 68 and are readily accessible to welding equipment through the bore 68. The common plane array of the projections 268 greatly facilitates "gang-welding" of the projections 264 to the internal wall 70 of the barrel terminal housing 62 as shown by the welds 266 in FIG. 16.

Referring now to FIGS. 17–21, there is depicted the construction steps according to another aspect of the method of the present invention for manufacturing an electrical connector utilizing a radially resilient socket.

Figure 17:
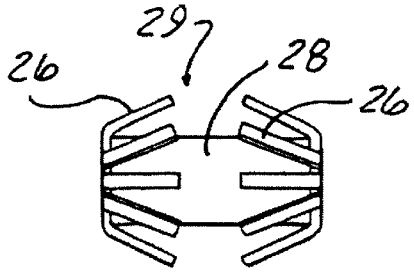
FIGS. 17–20 depict sequential steps in an alternate construction method of a barrel socket according to the present invention.
Figure 18:
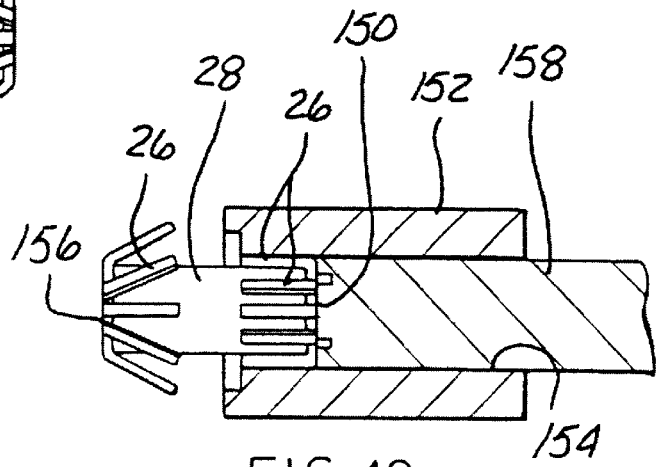

In FIG. 17, the sleeve 28 is depicted. This construction stage is similar to that described above and shown in FIG. 4 in which the blank 20 has been bent or formed into a cylinder and the outer sleeve 28 disposed closely there over with the tabs 26 projecting outward from opposite ends of the sleeve 28 as shown in FIG. 3.

However, in this aspect of the present invention, the tabs 26 at both ends of the sleeve 28 are bent or folded around the outer ends of the sleeve 28 and back over the outer surface of the sleeve 28 to form a cartridge 29.

The first end 150 of the cartridge 29 is then inserted into a first housing or fixture 152 having a bore 154 formed therein. The inner diameter of the bore 154 is sized slightly larger than the outer diameter of the sleeve 28 by a distance equal to the thickness of the tabs 26 so as to closely fold over the tabs 26 into face-to-face engagement with the outer surface of the sleeve 28 when the first end 150 of the cartridge 29 is inserted into the first housing 152. It should be noted that the cartridge 29 is only partially inserted into the bore 154 in the first housing 152 such that the second end 156 of the sleeve 28 projects outwardly from the first housing 152 along with the tabs 26 at the second end 156 of the sleeve 28.

The first end 150 of the cartridge 29 is inserted into the bore 154 in the first housing 152 until the first end 150 engages one end of a rotatable tool 158 which is rotatably and axially movably disposed within the bore 154. The tool 158 can be similar to the tool 50 described above and shown in FIG. 7 and has teeth which engage the spaces between adjacent folded over tabs 26 at the first end 150 of the sleeve 28.

Figure 19:
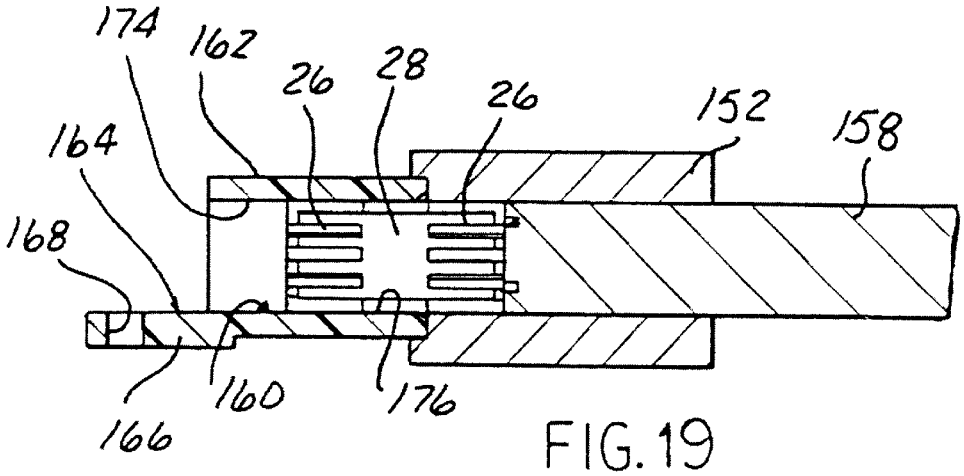

Next, as shown in FIG. 19, the second end 156 of the cartridge 29 is inserted into or otherwise brought into engagement with a bore 160 in a cylindrical portion 162 of a terminal, holder, support or electrical device, all referred to generally hereafter as a holder 164. The cylindrical portion 162 is disposed at one end of a support or base 166, the opposite end of which, by example only, includes an aperture 168 for receiving a fastener 170, shown in FIG. 21, to secure another terminal 172 carrying an electrical conductor, again by example only, to the holder 164.

According to a preferred aspect of the present invention, the bore 160 in the cylindrical portion 162 is divided into two sections, namely, a first end section 174 and a second end section 176. The inner diameter of the first end section 174 is selected to create a press or interference fit with the tabs 26 at the second end 156 of the cartridge 29 when the second end 156 of the cartridge 29 is inserted into the bore 160. The second end section 176 of the bore 160 has a larger diameter than the first end section 174 to enable the second end 156 and the folded tabs 26 on the outer sleeve 28 to pass freely there through into press-fit engagement with the first end section 174 of the bore 160. This forcibly mounts the second end 156 of the cartridge 29 in the cylindrical portion 162 of the holder 164 and brings the tabs 26 at the second end 156 of the outer sleeve 28 into secure electrical contact with the inner surface of the bore 160.

Figure 20:
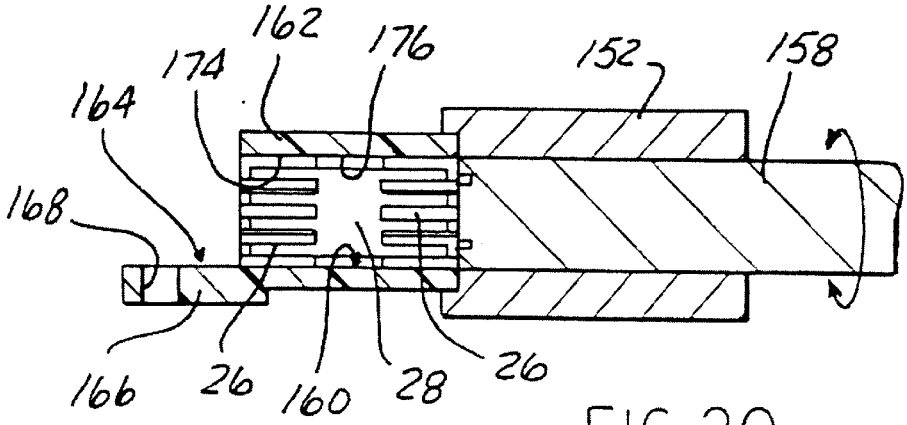
Figure 21:
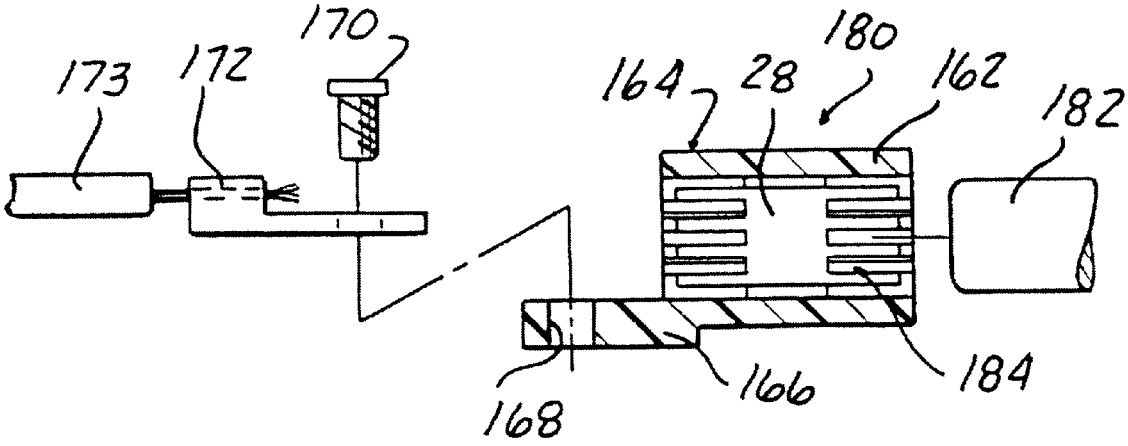
FIG. 21 is an exploded, partially cross section, side elevational view of the completed electrical connector constructed according the method of FIGS. 21–24 shown in an interconnected use position.

The cartridge 29 is forcible inserted into the bore 160 until the entire outer sleeve and folded over tabs 26 at the first end 150 of the cartridge 29 are fully enclosed within the bore 160 as shown in FIG. 20.

As described above, the second end section 176 of the bore 160 has a larger inner diameter than the adjacent first end section 174. This can be formed in a number of constructions, including a gradual decreasing diameter taper along the length of the bore 160 from the first end section 176 to the second end section 178. Alternately, a step may be formed intermediate the ends of the cylindrical portion 162 to form two different diameter sections, one for the first end section 174 and the other for the second end section 176 of the bore 160.

As shown in FIG. 20, when the cartridge 29 is fully inserted into the bore 160, the second end 156 of the cartridge 29 and the folded over tabs 26 carried on the second end 156 are in a press-fit engagement with the inner surfaces of the cylindrical portion 162 surrounding the bore 160. However, the tabs 26 at the opposite end of the cartridge 29 will only be loosely disposed between the inner surfaces of the second end section 176 of the bore 160 and the adjacent outer surface of the sleeve 28.

The rotatable tool 158 can be advanced by a suitable drive source, such as a pressurized fluid cylinder, electric motor drive, etc., to slidably urge the first end 150 of the cartridge 29 and the folded over tabs 26 carried thereon from the first housing 156 into the bore 160 in the cylindrical portion 162 of the holder 164.

Next, as shown by the arrow in FIG. 20, the rotatable tool 158 is rotated to angularly offset the tabs 26 at the first end 150 of the cartridge 29 from the corresponding tabs 26 at the second end 156 of the cartridge 29. This provides the desired hyperbolic shape to the strips 24 between the webs 22 on the cylindrical blank as described above. With the rotatable tool 158 is held in the rotated position, the end portion of the cylindrical portion 162 of the holder 164 surrounding the second end section 176 of the bore 160 is subjected to a swaging operation which deforms the end portion of the cylindrical portion 162 and decreases its inner diameter to bring the inner diameter of the end portion of the cylindrical portion 162 into tight, close fitting engagement over the tabs 26 at the first end 150 of the outer sleeve 28 so that the tabs 26 are tightly held between and in contact with the outer surface of the sleeve 28 and the inner surface of the bore 160. The rotatable tool 158 is then withdrawn along with the first housing 152 leaving the completed connector denoted by reference number 180 in FIG. 21.

As described above, a terminal 172 carrying an electrical conductor 173 may be securely attached to the aperture 168 in the support 166 of the holder 164 by means of a threaded fastener or screw 170. Alternately, the holder 166 and the terminal 172 can be a unitary one piece member like the holder 62. An elongated, cylindrical pin 182 may be releasably inserted into the interior of the barrel socket 184 to couple the electrical device or circuit to which the pin 182 is attached with the circuit or conductors or electrical device to which the conductor 173 and terminal 172 are connected via the socket 184 and the holder 164.

In yet another method, the bore 160 is smooth, but sized for a press fit with the tabs 26. The cartridge 29 initially is inserted half way into the bore 160. Next, the tool 158 is rotated 15° to 45° to offset the tabs 26 and one end of the internal strips from the opposed tabs and the opposite end of the strips. The tool 158 then axially advances pushing the cartridge 29 fully into the bore 160 whereby the tabs 26 at both ends of the cartridge 29 are held in the angularly offset position through a press fit with the inner surface of the bore 160.

Figure 22:
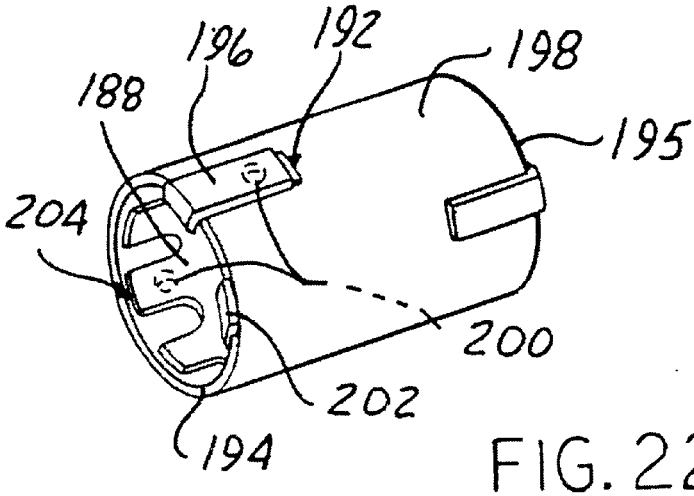
FIGS. 22–24 depict sequential steps in the construction method of the present invention for an alternate barrel socket.
Figure 23:
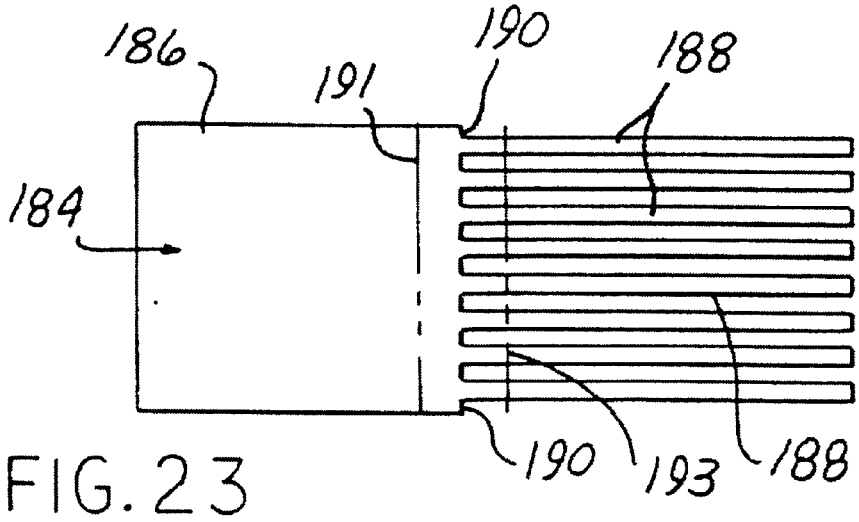
Figure 24:
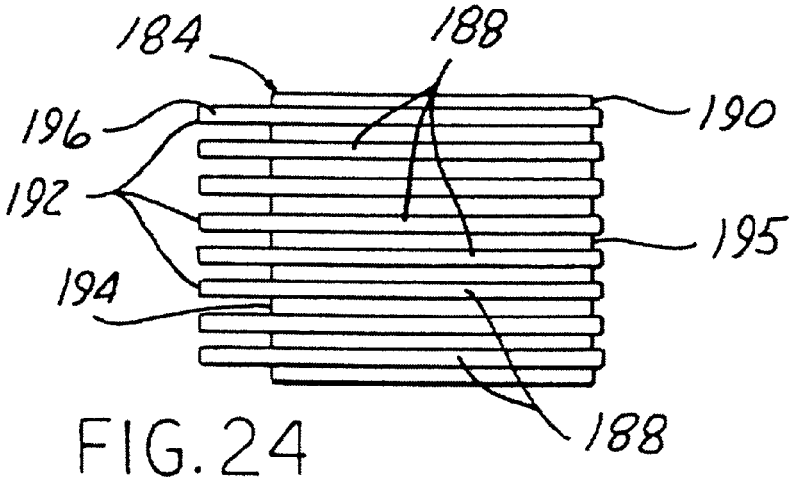

An alternate method of constructing the blank 20 and outer sleeve 28 described above and shown in FIGS. 1–4 as a unitary, one piece member is depicted in FIGS. 22–24.

In this aspect of the present invention, a one piece sheet metal blank 184 is formed with a first generally rectangular, solid end portion 186 and a plurality of elongated, generally flat strips 188 which extend longitudinally from one end of the solid end portion 186 and are equally spaced apart and disposed in parallel. The entire blank 184 may be formed of a suitable electrically conductive material, such as beryllium copper. The strips 188 are unitarily joined to one end of the solid end portion 186 at a first end 190 by welding or as a unitary stamping with the solid portion 186. Alternately, the strips 188 maybe joined to the blank 186 along lines 191 or 193 with suitably formed end portions on the strips 188 or the blank 186.

Next, all of the strips 188 are bent or folded over the second end 195 of the solid end portion 186 about the first end 190 and remain in parallel as shown in FIG. 23. As shown therein, the free ends 192 of each of the strips 188 extend beyond a first end 194 of the solid end portion 186. The portion of the strips 188 projecting beyond the first end 194 form tabs 196.

Next, as shown in FIG. 24, the solid end portion 186 is then folded into a cylindrical sleeve 198 and the edges welded or otherwise fixedly joined together. The folding operation carries the strips 188 overlaying one surface of the solid end portion 186 such that the strips 188 are now disposed within the interior of the resulting cylindrical sleeve 198 as shown in FIG. 24. The tabs 196 still project outward beyond the first end 194 of the sleeve 198.

At this point in the construction of the sleeve 198, the second end 195 may be inserted into tight engagement with a bore in a holder, as described above. The tabs 196 may be folded over the outer surface of the sleeve 198 and secured in the bore of a holder as described above and shown in FIG. 10, after the angular offset is imparted to one end of the strips 188, by either of the previously described construction methods.

Figure 25:
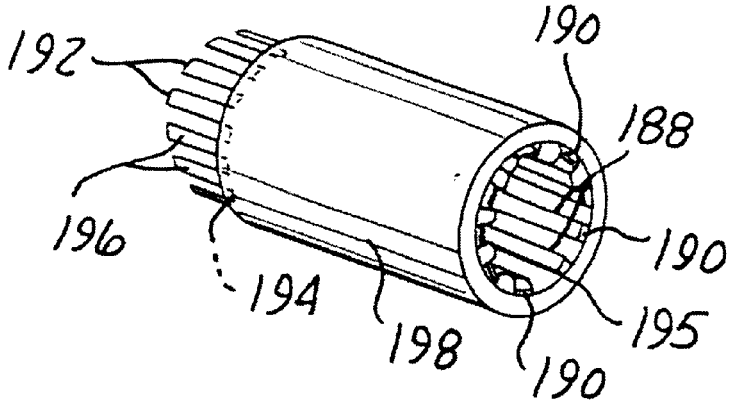
FIG. 25 is a perspective view showing multiple means for fixedly mounting the tabs of the contactor to the sleeve.

FIG. 25 depicts three different attachment locations or methods for attaching the tabs 196 or an end portion of the tabs 196 or the strips 188 to the outer sleeve 198. All three are depicted in a single sleeve 198 merely for convenience, it being understood that in an actual construction, one or more of the attachment methods could be employed for all of the strips 188 and tabs 196 in a single connector.

The different attachment methods share a common feature in that the tabs 196 or end portions of the strips 188 are fixedly secured to the sleeve 198 by welds. Since the weld cannot increase the thickness of the tab 196 or strip 188, a slight depression or aperture 200 can be formed at the end portion of the tabs 196 or strips 188 at the location of each weld.

Thus, according to one aspect of the invention, the tabs 196 are folded over the first end 194 of the sleeve 198 as in the above described embodiments of the invention and then welded to the outer surface of the sleeve 198. Alternately, the tabs 196 can be shortened so as to define a portion 202 which has a length only foldable over the first end 194 of the sleeve 198.

According to another aspect of the present invention, the strips 188 are formed without any tabs 196 such that the strips 188 terminate in an end 204 within the bore in the sleeve 198 adjacent to the first end 194 of the sleeve 198.

Regardless of which construction technique is employed, the end result is that the strips 188 are maintained in parallel at the first end 194 of the sleeve 198 and fixedly secured thereto after the freely movable end portions of the strips 188 at the first end 194 of the sleeve 198 have been rotated the desired amount as in the construction methods described above.

Figure 26:
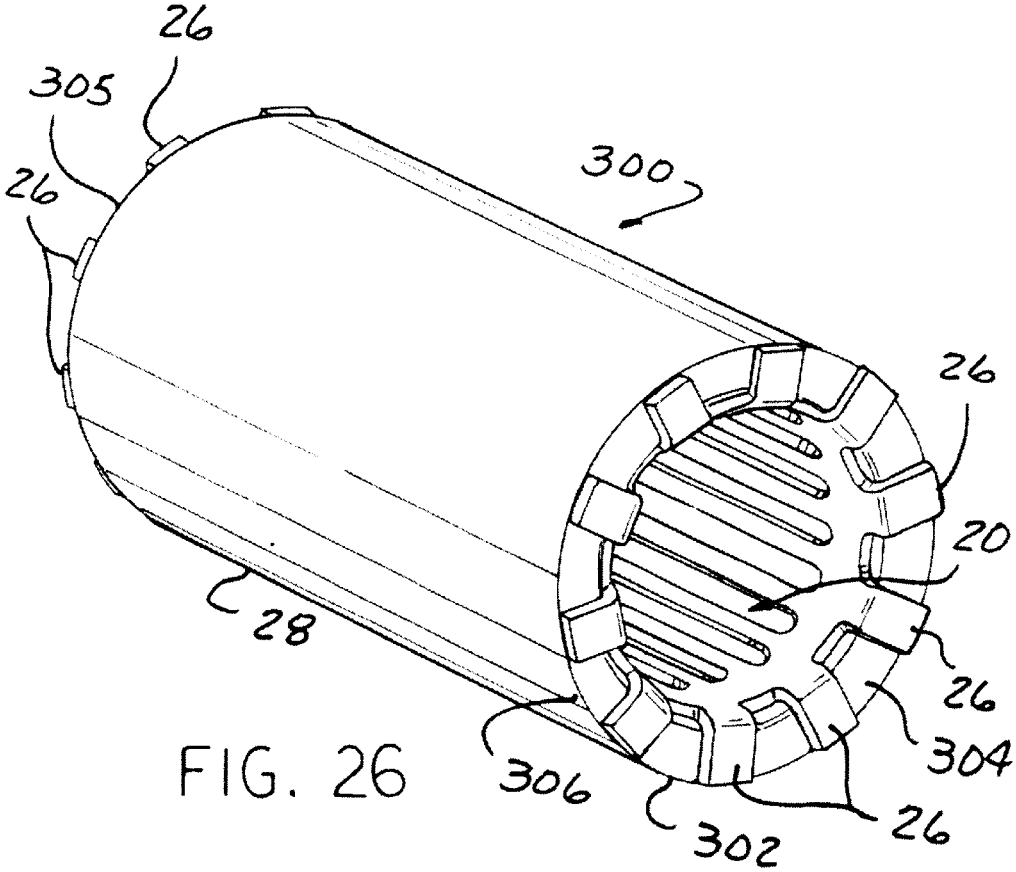
FIG. 26 is a perspective view of another aspect of an electrical connector according to the present invention.
Figure 27:
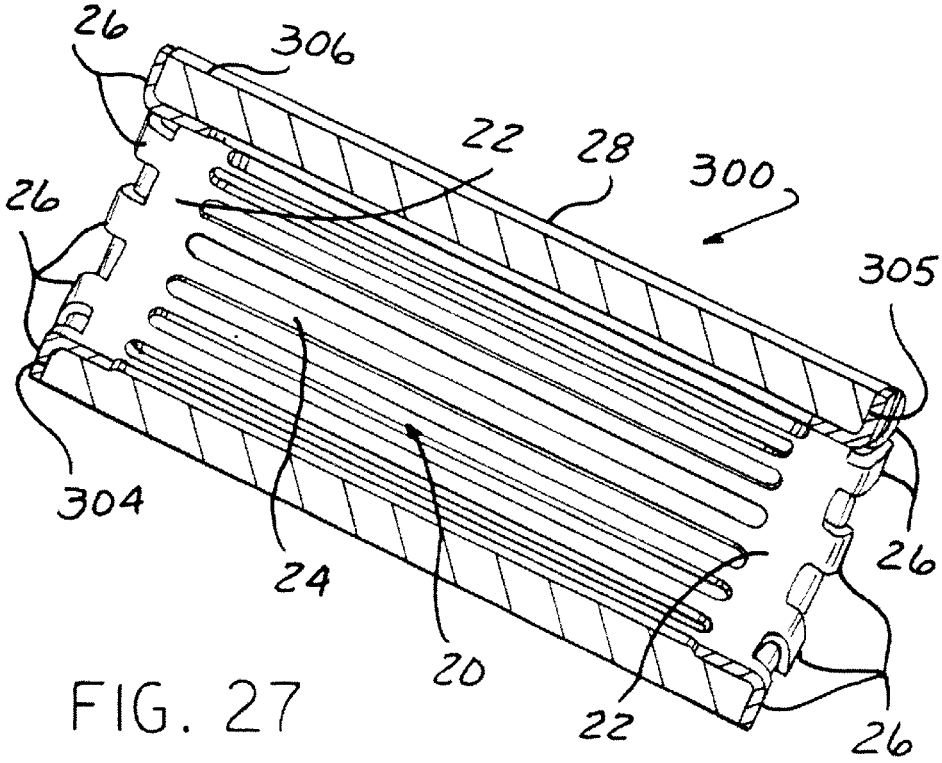
FIG. 27 is a longitudinal, cross-sectional view of an electrical connector shown in FIG. 26, with the grid inserted into the sleeve, but before the angular offset as applied to the grid strips.

Referring now to FIGS. 26 and 27, there is depicted an electrical connector 300 constructed in accordance with the teachings of another aspect of the present invention. The electrical connector 300 is formed as a cartridge which can be mounted in a use element, as described above.

The electrical connector 300 includes a contactor or grid, such as the grid 20 described above and shown in FIG. 1. The grid 20, which may initially be formed as a flat blank, is formed or bent into a cylindrical, tubular shape as shown in FIG. 2 and inserted into a cylindrical, concentric outer sleeve 28 as shown in FIG. 3.

In this aspect of the invention, the tabs 26 projecting from the webs at each end of the grid 20 are formed with a length to be disposed in a predetermined position with respect to one end 302 of the sleeve 28, the outer side end wall 304 of the sleeve 28, or in a wrap around configuration over the outer end surface 306 of the sleeve 28, all of which are depicted in FIG. 25. Thus, by way of example only, the tabs 26 are depicted as having a length which allows each tab 26 to be bent radially outward from the cylindrical, axially extending shape shown in FIG. 3 over and in close proximity or contact with the end wall 304 of the sleeve 28. The tabs 26 are fixedly secured to the end wall 304 of the sleeve 28 by welding, such as ultrasonic welding, spot welding, impulse-capacitor discharge welding or, possibly, low-temperature brazing or soldering.

In the same manner as shown in FIG. 26, the tabs 26 could also be welded to the inner surface of the sleeve 28 adjacent the end wall 304 or provided with a longer length and wrapped around the end portion 306 of the outer surface of the sleeve 28 as shown by reference number 196 in FIG. 25 and then welded to the exterior surface 306 of the sleeve 28.

The angular offset or rotation, as described above, is applied to the tabs 28 at the other end of the grid 20 before the tabs 26 at the opposite end of the grid 20 are fixedly secured by any of the welding methods described above to either the interior end surface, the opposed end wall 305 or the exterior end surface 306 of the sleeve 28.

The above described connector 300 affords a compact connector in a cartridge form which can be mounted in a bore in a use element for receiving an electrical conductor or pin in a smooth, slide-in connection. The hyperbolic arrangement of the strips 24 in the grid 20 between the opposed webs 22 of the grid 20 assure secure electrical contact with the inserted conductive member as well as affording a high friction force resisting conductor or pin pull-out from the conductor 300.

What is claimed is:

1. A connector comprising:

a cylindrical sleeve; and a contact member coaxially received within the sleeve, the contact member including:

a plurality of circumferentially spaced strips having first and second ends, one of the first and second ends of each strip being angularly offset with respect to a longitudinal axis of the sleeve from the opposed end of the respective strip; and the first and second ends of the strips non-movably fixedly welded in the angularly offset position with respect to the sleeve.

2. The connector of claim 1 wherein:

the opposed ends of each strip are folded over an exterior surface of the sleeve and welded to the exterior surface of the sleeve.

3. The connector of claim 1 wherein:

the opposed ends of the strips are folded over an end edge of the sleeve and welded to the end edge of the sleeve.

4. The connector of claim 1 wherein:

the opposed ends of the strips terminate interiorly of the opposed end of the sleeve; and the opposite ends of the strips are welded to an interior surface of the sleeve.

* * * * *